US005343977A

United States Patent [19]

Bryan

[11] Patent Number: 5,343,977

[45] Date of Patent: Sep. 6, 1994

[54] LADDER SHIELD

[76] Inventor: Robin R. Bryan, P.O. Box 9712, Greensboro, N.C. 27429

[21] Appl. No.: 885,511

[22] Filed: May 19, 1992

[51] Int. Cl.[5] ..... E06C 5/32

[52] U.S. Cl. ..... 182/106; 182/129; 182/77; 292/281

[58] Field of Search ..... 182/107, 129, 106, 77; 292/DIG. 72, DIG. 73, 341.12, 281–286; 70/DIG. 33, 2

[56] References Cited

U.S. PATENT DOCUMENTS

| | | | |
|---|---|---|---|
| 1,400,482 | 12/1921 | Ewing | 292/DIG. 73 X |
| 1,653,553 | 12/1927 | Edelmann | 292/DIG. 73 X |
| 1,679,244 | 7/1928 | Fitzgerald | 292/DIG. 73 X |
| 3,968,857 | 7/1976 | Bryan . | |
| 4,524,848 | 1/1985 | Russo . | |
| 4,664,225 | 5/1987 | Courtier . | |
| 5,026,100 | 6/1991 | Halkenberg | 292/DIG. 65 X |

*Primary Examiner*—Alvin C. Chin-Shue
*Attorney, Agent, or Firm*—Rhodes Coats & Bennett

[57] ABSTRACT

An improved safety shield for permanent ladders of the type having a pair of side rails and a plurality of rungs permanently secured to a support structure such as storage tanks, smoke stacks, television towers, tall buildings, bins and silos, the shield includes a front plate having two longitudinal side edges, a pair of side flanges, each of which extends rearwardly and outwardly from one of the side edges in angular relationship thereto. A hinge means connects a first of the side flanges and the front plate along juxtaposed side edges and at least one support bracket connects the first side flange to the ladder. The front plate has an opening and is movable between a first open position and a second closed position wherein the front plate, side flanges, and supporting structure substantially enclose the ladder to prevent unauthorized access thereto. A locking means includes a looped portion for insertion through the opening in the front plate to secure the front plate in the closed position, including a support bracket for connecting the looped portion to the ladder and biasing element biases the plate outwardly to minimize the play of the plate when secured in the closed position by a padlock through the loop. A supplemental barrier prevents unauthorized access to the rear of the ladder from beyond the edge of the side flanges.

4 Claims, 2 Drawing Sheets

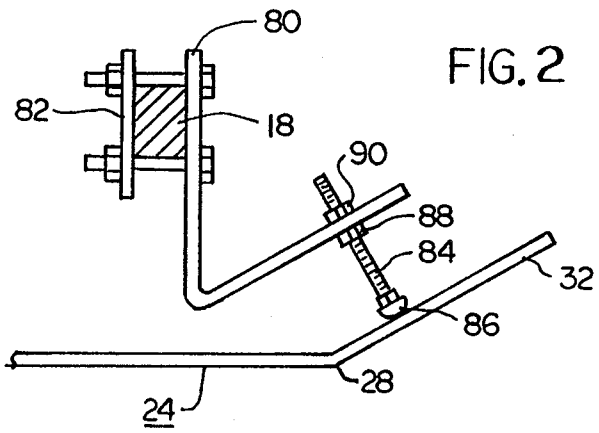
FIG. 2
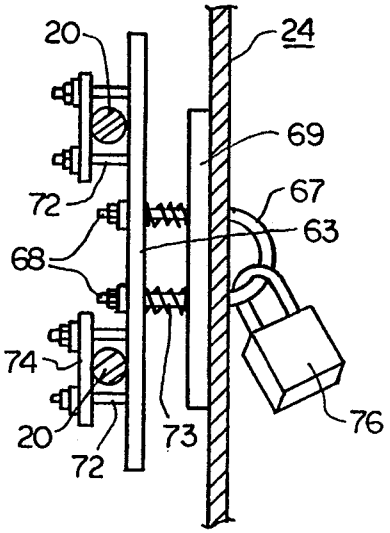
FIG. 3
FIG. 1
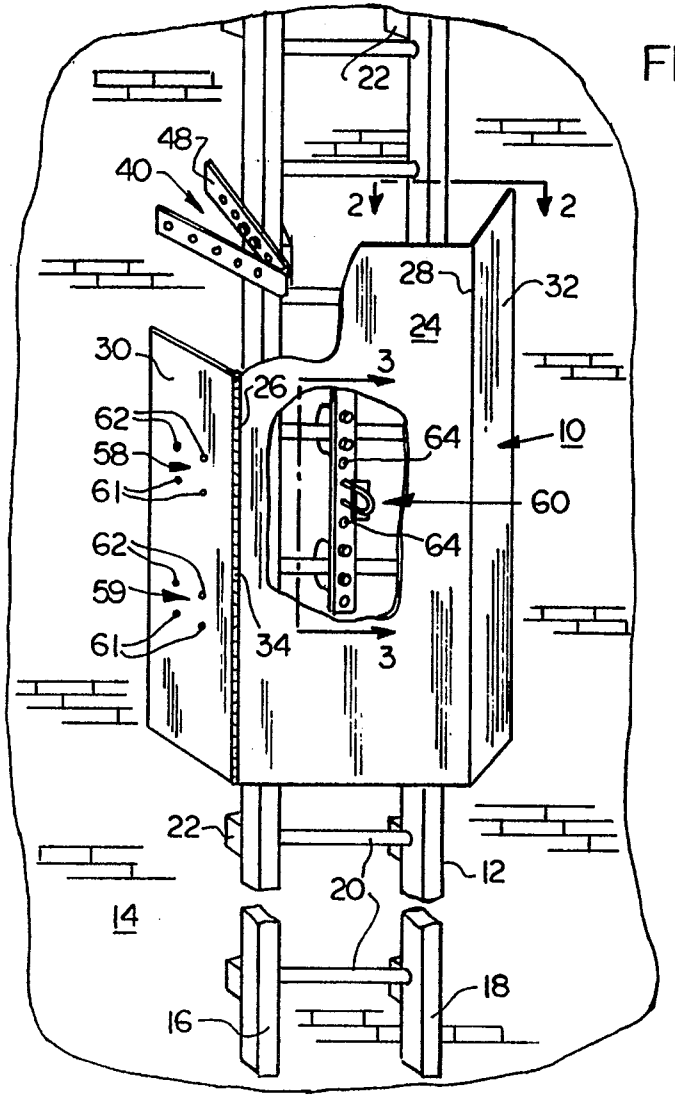

LADDER SHIELD

BACKGROUND OF THE INVENTION

This application discloses and claims an improvement on the invention of my prior U.S. Pat. No. 3,968,857, the entire disclosure of which is incorporated herein by reference.

The owners of storage tanks, smoke stacks, television towers, tall buildings and other storage bins and silos subject themselves to possible liability resulting from unauthorized use by children of the permanent ladders secured thereto. Where a child wanders onto the property on which a storage tank or silo is located, and is injured while climbing the ladder, the owner of the property may be liable. Therefore there is a need for some type of safety shield for preventing unauthorized use of the ladder.

My prior patent provided such a shield, which has achieved considerable commercial success and generally functions quite well. However, experience has indicated a couple of aspects of the apparatus which could benefit from further improvement. First, the shield has been constructed to receive an eye-bolt through which a padlock or the like is passed to lock the shield in place preventing access to the ladder. In order to permit various padlock designs to be used, it has been necessary to make the eye-bolt opening large enough to receive the largest of the possible padlocks. When smaller padlocks are used, this results in some continuing freedom of movement of the shield. Since the shield is mounted outdoors at an elevation, the wind continually moves the shield, resulting in excessive wear and possible premature failure.

Second, when the shield is mounted on most ladders, it does an excellent job of preventing unauthorized use of the ladder, because the shield includes rearwardly extending side shields to prevent access to the backside of the ladder rungs. However, other ladders are spaced away from their supporting structures an unusually large distance (e.g. more than the seven inches (18 cm) required by OSHA) and thereby provide a "backdoor" access to the ladder, permitting intruders to circumvent the shield.

Thus, there is a continuing need in the art for an improved ladder shield to prevent excess play of the shield, and to prevent "backdoor" access.

SUMMARY OF THE INVENTION

The present invention is directed to a safety shield which may be installed on substantially all types of existing permanent, vertical ladders, such as those installed on storage tanks, stacks, radio and television towers, bins and silos and tall buildings. In this regard, the hardware associated with the shield of the present invention is of a type which includes brackets adapted to be secured to the rungs and rails of the ladder, and mount the shield thereto, whereby the shield may be installed on the ladder in one of several locations.

The shield hardware includes a biasing element to bias the installed shield outwardly, taking up any "slack" or "play" in the shield an thereby prevent its becoming damaged through continued rattling.

The shield includes not only a hinged front plate which may be selectively locked in a closed position, or unlocked and opened, but also rearwardly and angularly directed side flanges which extend to a point substantially adjacent the support surface, such as the bin or silo wall, for a typically installed ladder. When the front plate is closed, the shield with its side flanges and the support surface substantially enclose the entire ladder, so that children are prevented access from either the front, sides, or rear thereof. For ladders more widely spaced from their supports, a supplemental shield is provided to prevent "backdoor" access to the ladder.

In one aspect the invention provides an improved safety shield for permanent ladders of the type having a pair of side rails and a plurality of rungs permanently secured to a support structure such as storage tanks, smoke stacks, television towers, tall buildings, bins and silos. The shield includes a front plate having two longitudinal side edges, a pair of side flanges, each of which extends rearwardly and outwardly from one of the side edges in angular relationship thereto. A hinge means connects a first of the side flanges and the front plate along juxtaposed side edges. At least one support bracket is provided for connecting the first side flange to the ladder. The front plate has an opening and is movable between a first open position and a second closed position wherein the front plate, side flanges, and supporting structure substantially enclose the ladder to prevent unauthorized access thereto. A locking means includes a looped portion for insertion through the opening in the front plate to secure the front plate in the closed position, including a support bracket for connecting the looped portion to the ladder. A biasing element biases the plate outwardly to minimize the play of the plate when secured in the closed position by a padlock through the loop.

In one embodiment the looped portion is an eye-bolt having a shank portion and the biasing means is a plate and a spring urging the plate outward along the shank portion. In another embodiment the biasing means is a stud mounted on the locking means and adjustable in effective length to bear against and inhibit movement of the plate when the plate is secured in the closed position. If desired, the stud may have an elastomeric tip to bear against the plate.

In another embodiment the biasing means is a stud affixed to the ladder and adjustable in effective length to bear against and inhibit movement of the plate when the plate is secured in the closed position.

In another aspect the safety shield includes a supplemental barrier to prevent unauthorized access to the rear of the ladder from beyond the edge of the side flanges. The supplemental barrier may include an attachment to at least one of the side flanges to reduce any gap between the edge of the supplemental barrier and the support structure. An alternative embodiment the supplemental barrier includes at least one plate with a bracket to permit attachment to the ladder to extend between a rail of the ladder and the support structure. In another embodiment the supplemental barrier takes the form of a plate with mounting bracket to permit attachment to the side of the ladder toward the supporting structure to cover the rungs.

BRIEF DESCRIPTION OF THE DRAWINGS

Other objects of the invention will become apparent upon reading the following specification in view of the enclosed drawings, in which:

FIG. 1 is a perspective view, with parts broken away for the sake of clarity, illustrating the safety shield according to the present invention installed on a permanent ladder;

FIG. 2 is a sectional view taken substantially along line 2—2 in FIG. 1;

FIG. 3 is a sectional view taken substantially along line 3—3 in FIG. 1;

DETAILED DESCRIPTION OF THE PREFERRED EMBODIMENTS

Figure 4:
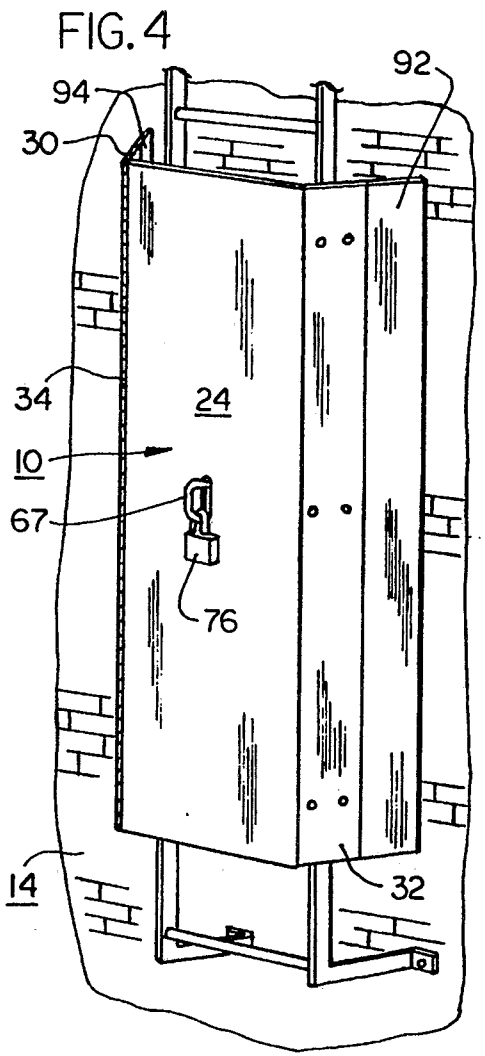
FIG. 4 is a perspective view of the shield with side supplements attached to prevent "backdoor" access.

Turning now to the drawings, and first of all to FIG. 1, the safety shield 10 according to the present invention is adapted for use with existing permanent, vertical ladders 12 of the type used in connection with storage tanks, water tanks, smoke stacks, t.v. towers, tall buildings, bins and silos. In this regard, the ladder 12 is permanently affixed to a wall or support surface 14 of the supporting structure in close proximity thereto so that, in most cases, a person cannot climb up the back side of the ladder. In some of these ladders, however, sufficient space exists between the support surface and the ladder, so that a person with access to the side of the ladder might conceivably be able to access the rear of the ladder. This situation is addressed with respect to FIGS. 4,5 and 6.

The ladder 12 with which the present invention is utilized, as best illustrated in FIG. 2, is of the type which comprises a pair of vertically extending rails 16,18 connected by a plurality of parallel, horizontally extending rungs 20. The side rails 16, 18 are permanently secured to the supporting structure 14 by means of gussets or plates 22 which are welded or otherwise permanently secured to both the support structure 14 and rails 16, 18.

A front plate 24 having longitudinal side edges 26,28 further includes a pair of side flanges 30,32, each of which is attached to one of the side edges 26,28 and extends rearwardly and outwardly therefrom in angular relationship thereto. A hinge means 34 connects side flange 30 with front plate 24, so that the front plate is selectively movable between a first, open position and a second, closed position. Whereas side flange 30 is formed as a separate member, side flange 32, may be formed by bending a longitudinal side portion of front plate 24 to a prescribed angle.

Side flange 30 is secured to rail 16 of the ladder by means of a plurality of connecting means 40. A locking means 60 is secured to the rungs 20 of ladder 12 and provides a means for securing the front plate 24 and the other side flange 32 in the closed position when the ladder is not in use by an authorized person.

The front plate 24 is horizontally adjustable with respect to the face of ladder 12, as described hereinafter, so that in mounting, the shield may be moved toward or away from the face of ladder 12 and support structure 14 to position the free edges of side flanges 30 and 32 as near to the surface of the support structure 14 as possible. As described hereinabove, this prevents access to the sides and rear edge of the ladder in most cases, so that a child or unauthorized user cannot use this portion of the ladder to boost themselves above the top edge of the safety shield to reach the upper portions of the ladder, which are considered to be the dangerous positions. Further, the safety shield 10 is mounted approximately 10 feet above the ground, i.e., the lower edge of front plate 24 is approximately 10 feet above the ground. The shield itself is approximately 8 feet long, so that the top edge of the safety shield is approximately 18 feet above the ground, which prevents the normal child, either alone or with others, from being able to scale above the safety shield. Further, because the lower edge is 10 feet from the ground, the shield may be manufactured with a minimum of material and weight. This considerably reduces the cost, as well as facilitating the installation, since it is much easier to install a shield if it is lighter and smaller. The light weight (totalling about 65 pounds including the hardware), plus having a length not longer than 8 feet keeps down the shipping costs. For that matter, it is anticipated that the shield according to the present invention can be assembled by a single person as will be explained hereinbelow.

The face of such permanent ladders are normally installed at a distance of approximately seven inches (18 cm) as required by OSHA from the surface of the supporting structure onto which they are mounted. With this in mind, side flanges 30 and 32 are of such a length and extend rearwardly at such an angle that the shield 10 may be adjusted toward and away from the face of the ladder as necessary to position the free edges of the flanges substantially adjacent the surface of the supporting structure without substantially increasing the distance between the front plate 24 and the face of the ladder. This relationship holds true regardless of the width of the ladder, which may vary from 10 to 22 inches, depending on the type of ladder. With these variances in mind, it has been found that preferably the front plate 24 should have a width of approximately 18 inches, while the side flanges should have a width of approximately 9 inches. Also, the side flanges should be connected to the front plate 24 at an angle of approximately 45°. Such a construction has been found to adapt the safety shield for use with most permanently installed ladders.

For a discussion of the specifics of the connecting means 40, the reader is referred to my prior patent, mentioned above.

The locking means 60, as illustrated in FIG. 3, includes a support rod 63, formed of some suitable type of metallic bar or tube stock, having a plurality of perforations 64 extending therethrough at spaced positions along the length thereof. Support rod 63 is of a length greater than the distance between two adjacent rungs 20, and is preferably about 20 inches long. An eye-bolt 67 is secured by extending the free ends thereof through adjacent the perforations 64 and applying some type of securing means such as fastener nuts 68 to the ends thereof. The support rod 63 is secured to two adjacent rungs 20 of ladder 12 by means of fastening elements 72 which protrude through selected perforations 64 in the support rod 63 and cooperating openings in securing plates 74 on the opposite side of rungs 20. The front plate 24 includes a slotted opening through which eye-bolt 67 extends when the front plate 24 is in the closed position. A padlock or other type of locking device 76 may then be applied to the eye-bolt 67 for securing the safety shield. In my prior patent, especially as shown in its FIG. 4, the size of the eye-bolt 67 was shown to be great. This was and is desirable to permit various locking devices 76 to be used, accommodating various diameters of their shanks. However, it has been found that when a padlock smaller than the opening in the eye-bolt is used, the plate 24 has a remaining freedom of movement. Since the plate has a substantial surface area an is located above ground level outdoors, it is subject to being buffeted by the wind. This makes objectionable noise and may damage the plate 24. Accordingly, the present invention provides a biasing means to urge the plate 24 outwardly against the padlock to eliminate their freedom of movement One way of doing this is seen in FIG. 3. The posts 68 of the eye-bolt 67 extend through holes in a plate 69, and through springs 71 and 73 before being secured to the support rod 63. In this way, the plate 69 urges the plate 24 outwardly, away from the supporting structure 14 and against the padlock 76, to eliminate the freedom of movement of the plate 24.

Another way is seen in FIG. 2. A V-shaped bracket 80 is secured to rail 18 of the ladder by a clamp 82. The bracket is provided with a hole through which a bolt 84 extends, and is fixed in a selected position by nuts 88, 90. The head of the bolt 84 may be provided with a rubber or other elastomeric bumper 86, or may be the metal of the bolt. The effective length of the bolt outward of the bracket 80 is selected upon installation to be against the plate 24 when the padlock 76 is in place, to remove the slack or play in the positioning of the plate. Thus, the movement of the plate 24 in the wind is restrained between the head 86 an the padlock. Of course, each of the stopping mechanisms of FIGS. 2 and 3 may be located at the positions of the other figure. Other mechanisms and other placement locations may be used. Although the drawings show the use of both, either can be used by itself.

While the above-described structure is quite effective for most ladder installations, when the ladder stands off from the supporting structure by an abnormally large amount, access to the rear of the ladder may be possible. Accordingly, the invention provides accessories to be used with the above-described shield components to prevent such rear access.

One such accessory can be seen in FIG. 4. Side flange extensions 92, 94 may be provided on the flanges 32, 30 to increase their length so that they extend rearwardly far enough to prevent access to the back side of the ladder. The extensions 92, 94 may be affixed to the flanges 32, 30 in any desired fashion, but preferably in a tamper-proof manner, to prevent disabling of the effectiveness of the shielding. The extensions 92, 94 act as a supplemental barrier to reduce the gap between the edge of flanges 32, 30 and the support structure.

Figure 5:
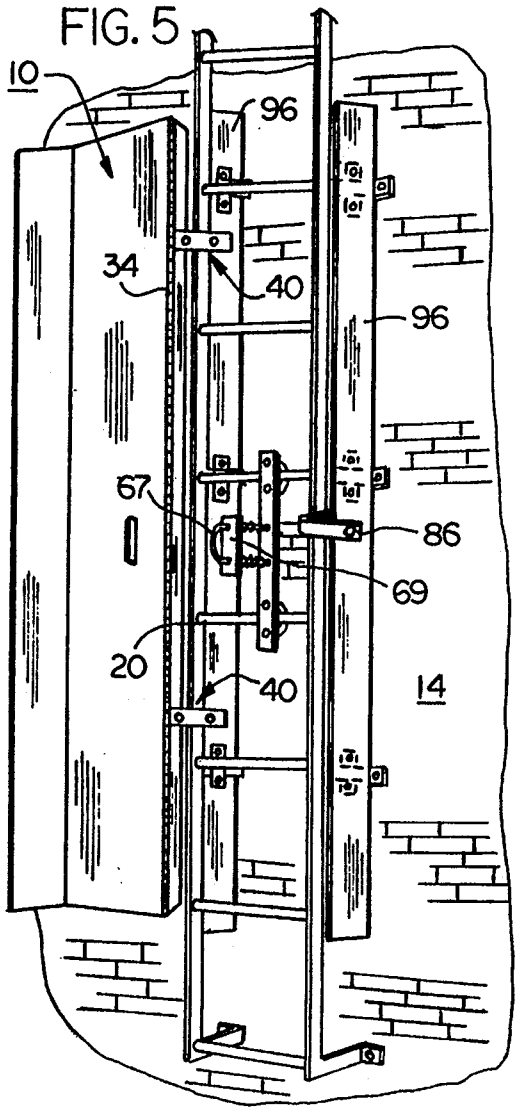
FIG. 5 is a perspective view of another embodiment for preventing "backdoor" access.

An alternative such accessory can be seen in FIG. 5. In this embodiment, panels 96 are provided with brackets on one side for affixation to the rails of the ladder or the gussets 22. The brackets are provided on the inside of the panels to make them inaccessible to vandals or intruders. The panels are made wide enough to span a sufficient amount of the distance from the rails to the supporting structure to prevent access to the rungs 20 around the side flanges. Thus, the panels act as a supplemental barrier extending between rails of the ladder and the supporting structure.

Figure 6:
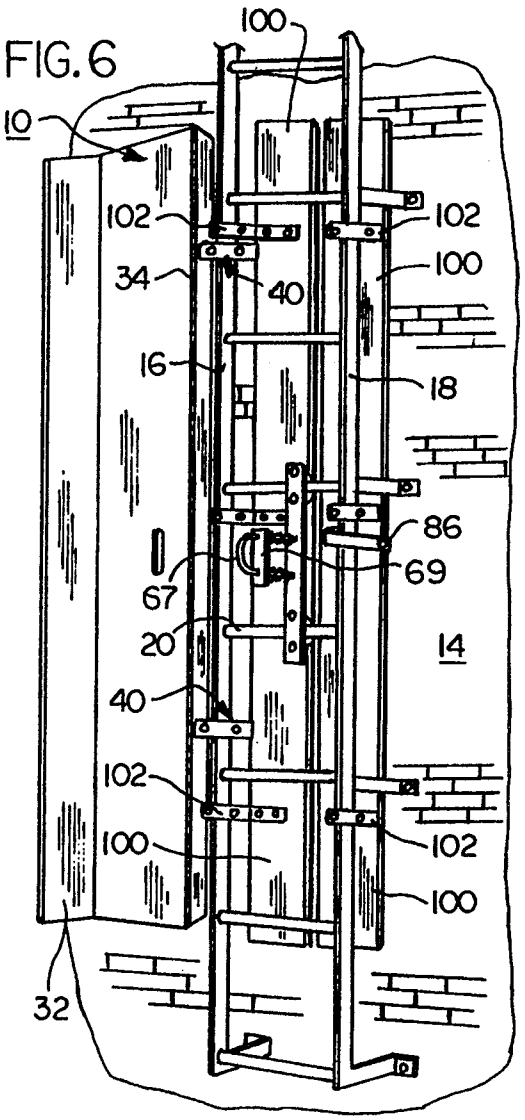
FIG. 6 is a perspective view of a third embodiment for preventing "backdoor" access.

A third embodiment can be seen in FIG. 6. Panels 100 are provided with brackets 102 for placement behind the rungs 20. The brackets permit the panels to be affixed to the ladder by being joined to the rails in much the same manner as the brackets 40. Preferably the brackets are long enough so the panels stand back of the rungs six inches to allow toe room for a person legitimately using the front of the ladder. Thus, the panels form a supplemental barrier on the back side of the ladder toward the supporting structure to cover the rungs and prevent a rear access.

In the vast majority of cases, the embodiments of FIGS. 4,5 and 6 are used alone, but extra security may be obtained by using two or more in combination with one another.

Although the invention has been described with reference to a permanent ladder affixed to the side of storage tanks or a silo, it is obvious that the invention is equally adaptable for use with water tanks, t.v. towers, and the like. In such situations, it may be that the surface of the support structure does not extend outwardly from the side rails of the ladder, in which case the flanges 30,32 will merely extend rearwardly past the edges of the support structure surface, however the effect will still be to prevent access to the sides and rear portion of the ladder.

The shield and all hardware are designed so that the shield can open to the left (as shown in FIGS. 1, 2, 4, 5 and 6) or turned upside down and installed to open to the right. This adds versatility in case of obstructions on the left or right of the ladder.

Also, it is obvious that various other changes and modifications may be made to the details of the construction without departing from the general spirit of the invention as set forth in the appended claims.

What is claimed is:

1. An improved safety shield for permanent ladders of the type having a pair of side rails and a plurality of rungs permanently secured to a support structure such as storage tanks, smoke stacks, television towers, tall buildings, bins and silos, said shield comprising:

a. a front plate having two longitudinal side edges;

b. a pair of side flanges, each of which extends rearwardly and outwardly from one of said side edges in angular relationship thereto;

c. a hinge means connecting a first of said side flanges and said front plate along juxtaposed side edges;

d. at least one support bracket for connecting said first side flange to said ladder;

e. said front plate having an opening and being movable between a first open position and a second closed position wherein said front plate, side flanges, and supporting structure substantially enclose said ladder to prevent unauthorized access thereto;

f. a locking means including a looped portion for insertion through said opening in said front plate to secure said front plate in said closed position, including a support bracket for connecting said looped portion to the ladder; and g. a biasing element mounted on said looped portion to bias said plate outwardly to minimize the play of the plate when secured in the closed position by a padlock through said loop.

2. The safety shield according to claim 1 wherein said looped portion is an eye-bolt having a shank portion and the biasing means is a smaller plate and a spring urging the smaller plate outward along said shank portion.

3. The safety shield according to claim 1 wherein said opening includes at least one slotted opening therein, said locking means includes a support rod having said looped portion secured thereto, said looped portion being adjustably mounted to the rings of said ladder at one of a plurality of positions along the length of said support rod, whereby said looped portion may be adjusted vertically with respect to said ladder rungs to align with said slotted opening in said front plate when said front plate is in said closed position.

4. The safety shield according to claim 1 further comprising a supplemental barrier to prevent unauthorized access to the rear of the ladder from beyond the edge of said side flanges.

* * * * *